US006690909B2

(12) United States Patent
Su

(10) Patent No.: US 6,690,909 B2
(45) Date of Patent: Feb. 10, 2004

(54) DOUBLE-SIDED PRINTING DEVICE FOR PAPER HANDLING

(75) Inventor: Yu-Jen Su, Taipei (TW)

(73) Assignee: Silitek Corporation, Taipei (TW)

( * ) Notice: Subject to any disclaimer, the term of this patent is extended or adjusted under 35 U.S.C. 154(b) by 0 days.

(21) Appl. No.: 10/216,217

(22) Filed: Aug. 12, 2002

(65) Prior Publication Data

US 2003/0175059 A1 Sep. 18, 2003

(30) Foreign Application Priority Data

Mar. 15, 2002 (TW) ..... 91203175 U

(51) Int. Cl.[7] ..... G03G 15/00

(52) U.S. Cl. ..... 399/364; 271/902; 399/401; 400/624

(58) Field of Search ..... 399/16, 364, 401; 271/186, 225, 902; 101/229, 230, 234, 262, 296; 355/24; 400/624

(56) References Cited

U.S. PATENT DOCUMENTS

| | | | | | |
|---|---|---|---|---|---|
| 5,772,343 | A | * | 6/1998 | Beretta et al. | 400/624 |
| 6,167,231 | A | | 12/2000 | Blackman et al. | 399/364 |
| 6,290,410 | B1 | * | 9/2001 | Sunada et al. | 400/624 |
| 6,332,068 | B2 | | 12/2001 | Blackman et al. | 399/364 |
| 6,463,256 | B2 | * | 10/2002 | Blackman | 399/401 |

* cited by examiner

*Primary Examiner*—Sophia S. Chen
(74) *Attorney, Agent, or Firm*—Birch, Stewart, Kolasch & Birch, LLP

(57) ABSTRACT

A double-sided printing device for paper handling is proposed by the invention to allow users to print on both sides of a sheet of paper. The double-sided printing device employs the interaction between the switches, the obstructing unit and the turning unit to allow a sheet of paper to enter the turning unit and be turned over so that its back side will be directed to the printing unit.

15 Claims, 15 Drawing Sheets

DOUBLE-SIDED PRINTING DEVICE FOR PAPER HANDLING

BACKGROUND OF THE INVENTION

1. Field of Invention

The invention relates to a printing device for paper handling applied to print data and/or records on paper, and especially relates to a double-sided printing device for paper handling.

2. Related Art

Conventional printing apparatuses are fax machines, printers and photocopiers, and printers can be furthermore classified as dot matrix, ink jet and laser printers. In accordance with the mechanisms of paper-picking, they can also be classified as front and back input tray printers.

Recycled paper is often used with printers, and it is preferable to use both sides of a sheet of paper when printing. But because the papers are re-used, they often become jammed inside the printer during the process of paper-picking, which wastes time and can damage the printer. If both sides of a sheet of paper are used for printing less paper is wasted.

In order to overcome the above problems some inventions have been proposed, such as U.S. Pat. Nos. 6,167,231 and 6,332,068. Although by these two inventions double-sided printing is achieved, some problems still occur and are described as follows:

1. The designs of the double-sided printing devices of the previous inventions are only useful for the front input tray printers but not for the back input tray printers.
2. The designs of the double-sided printing devices of the previous inventions are oriented externally. The production cost for these devices is increased.

SUMMARY OF THE INVENTION

The object of the invention is to provide a double-sided printing device in order to overcome the above problems. The device of the invention is designed internally and is driven by a single drive so that the production cost can be decreased.

The double-sided printing device proposed by the invention comprises a holding unit, a first switch, a drive, a printing unit, a turning unit, an obstructing unit and a second switch. Some papers are placed in the holding unit, the first switch is driven by the reverse rotation of the drive to couple with the holding unit such that a sheet of paper placed in the holding unit is pulled out and by the ordinary rotation of the drive is fed into the printing unit so that printed data can be printed on its front side.

After completing the printing on the front side of the sheet of paper, the second switch is driven by another reverse rotation of the drive to couple with the turning unit such that the sheet of paper is guided into the turning unit and turned over. At this time the obstruction unit is applied to stop the first switch from coupling with the holding unit to prevent it from feeding papers repeatedly. Finally the drive rotates normally to pull the second switch to free from the turning unit so that the sheet of paper can be fed into the printing unit and the printed data can be printed on the back side of the sheet of paper.

A page sensor can also be applied to actuate the obstructing unit to reduce control problems. The page sensor is set on the path for paper handing and when a sheet of paper goes through it, it is initiated to push the obstructing unit to function normally.

Further scope of applicability of the invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

Figure 1:
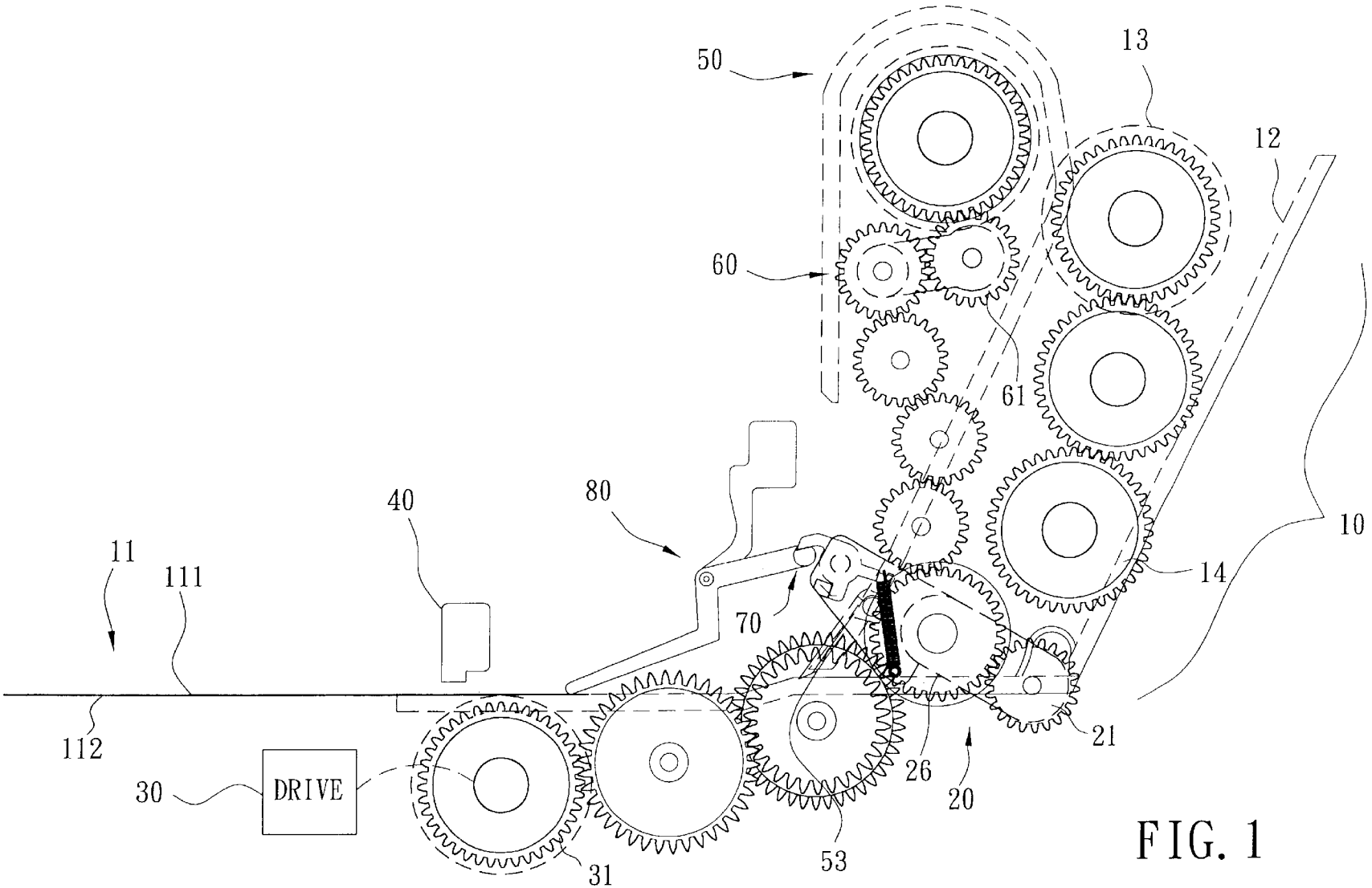
FIG. 1 is a schematic drawing of the invention.

Referring firstly to FIG. 1, the double-sided printing device of the invention comprises a holding unit 10, a first switch 20, a drive 30, a printing unit 40, a turning unit 50, a second switch 60, an obstructing unit 70 and a page sensor 80. The holding unit 10 possesses a reservoir 12 in which papers are placed while the first switch 20 is set on the bottom of the holding unit 10 and the passive gear 21 on the first switch 20 can be coupled selectively with the holding unit 10. A sheet of paper 11 placed inside the holding unit 10 is fed to the printing unit 40 by a supplying roller 13 such that printed data can be printed on the sheet of paper 11. Between the first switch 20 and the supplying roller 13 some gears are set and the numbers of gears is dependent upon the length of the sheet of paper 11 and the types of the printers.

The drive 30 is coupled with the gear 26 by a feeding roller 31, and the numbers of gears set between the feeding roller 31 and the gear 26 depends upon the types and designs of the printers. Naturally the drive 30 can also be directly coupled with the gear 26. Above the feeding roller 31 a printing unit 40 is set which can be applied to print data on the sheet of paper 11 that is fed by the feeding roller 31. In the back of the printing unit 40 a turning unit 50 coupled with the second switch 60 is set. It is applied to turn over the sheet of paper 11 such that the reverse side 112 of the sheet of paper 11 can be printed upon by the printing unit 40 after the front side 111 of the sheet of paper 11 has been used. The method of paper-handing for the sheet of paper 11 and the actuations of the first and second switches 20 and 60 are described together with the drawings as follows.

Figure 2:
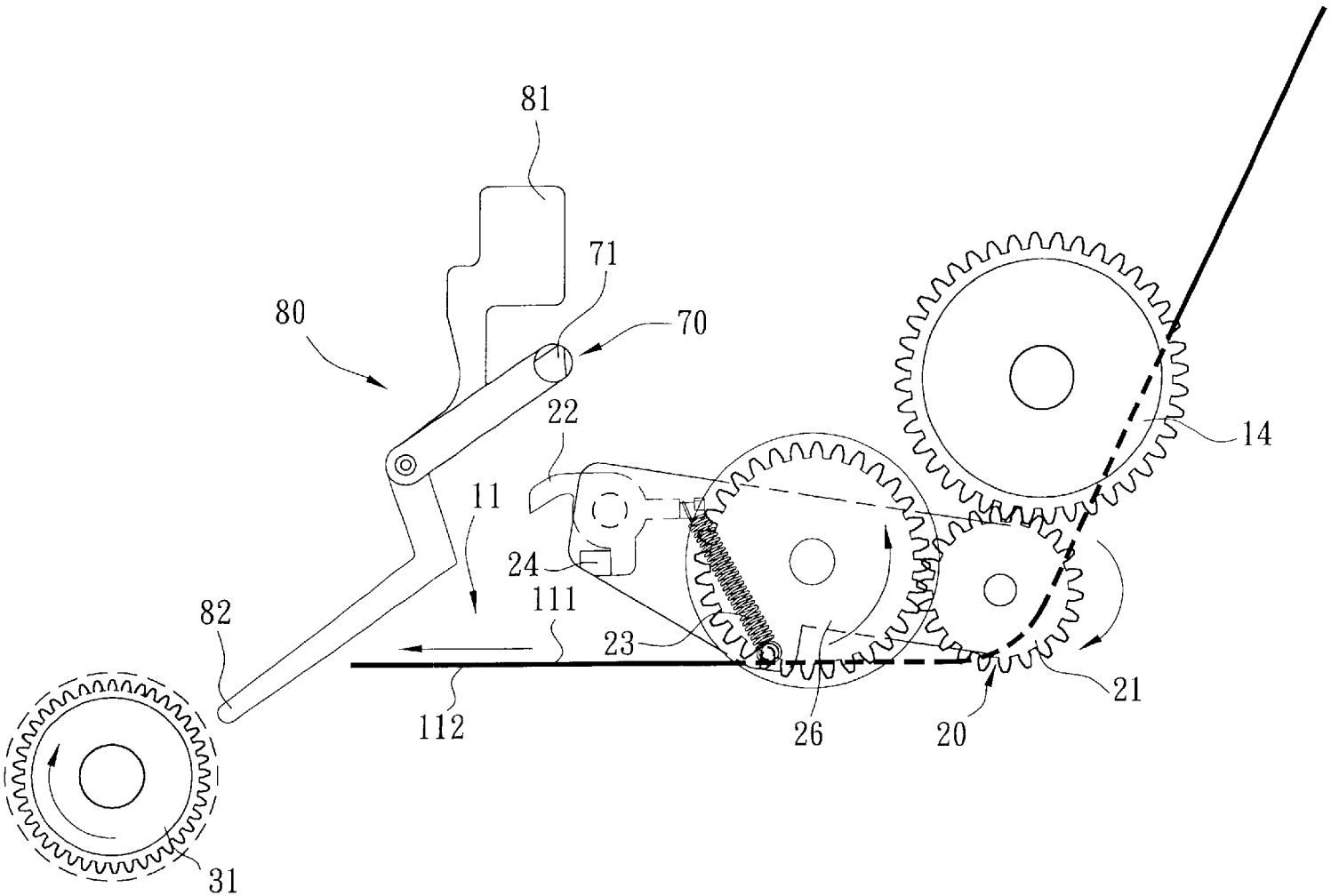
FIG. 2 is a schematic drawing of the paper-picking mechanism of the invention.
Figure 3:
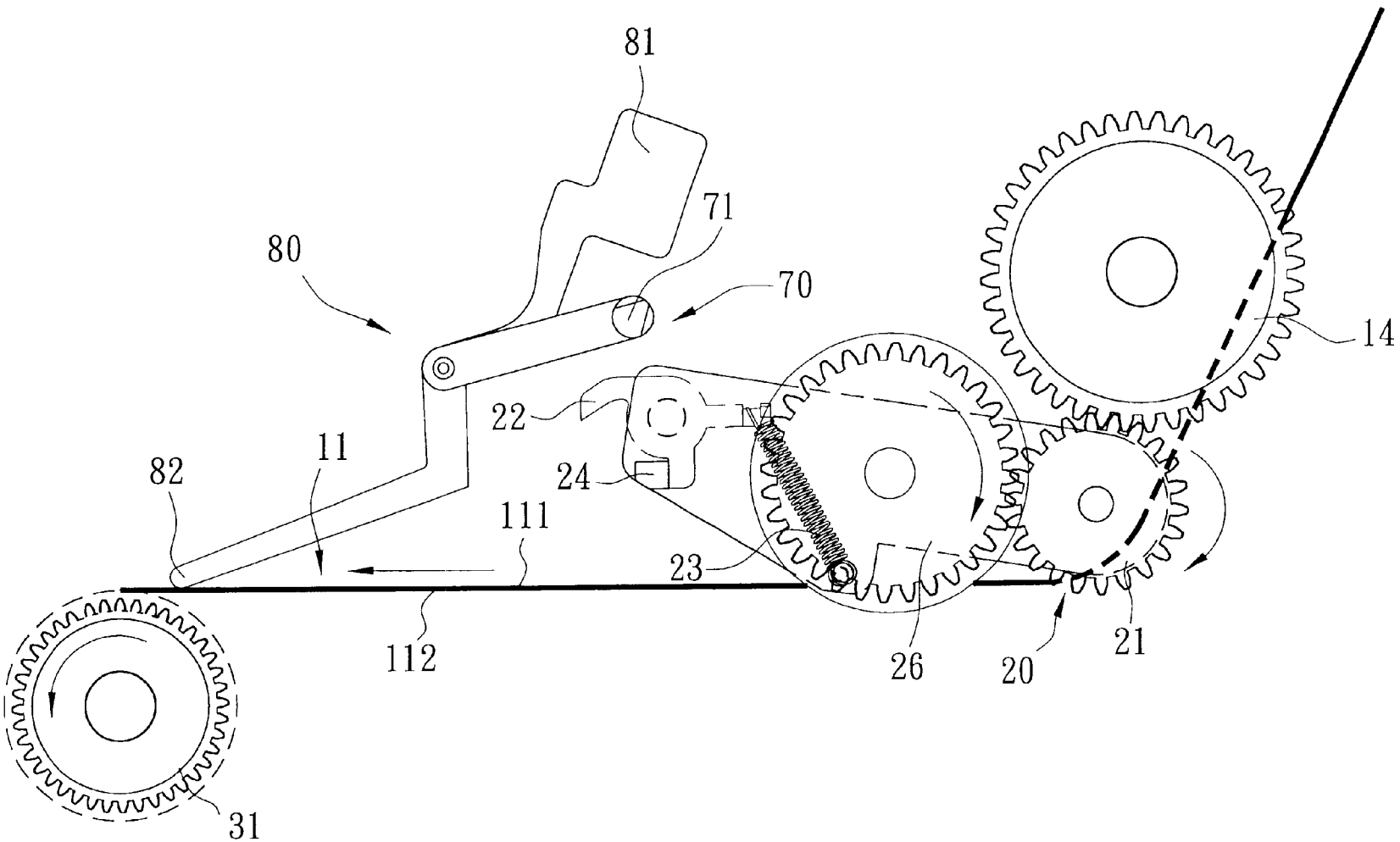
FIG. 3 is a schematic drawing of the page sensor used to drive papers of the invention.
Figure 10:
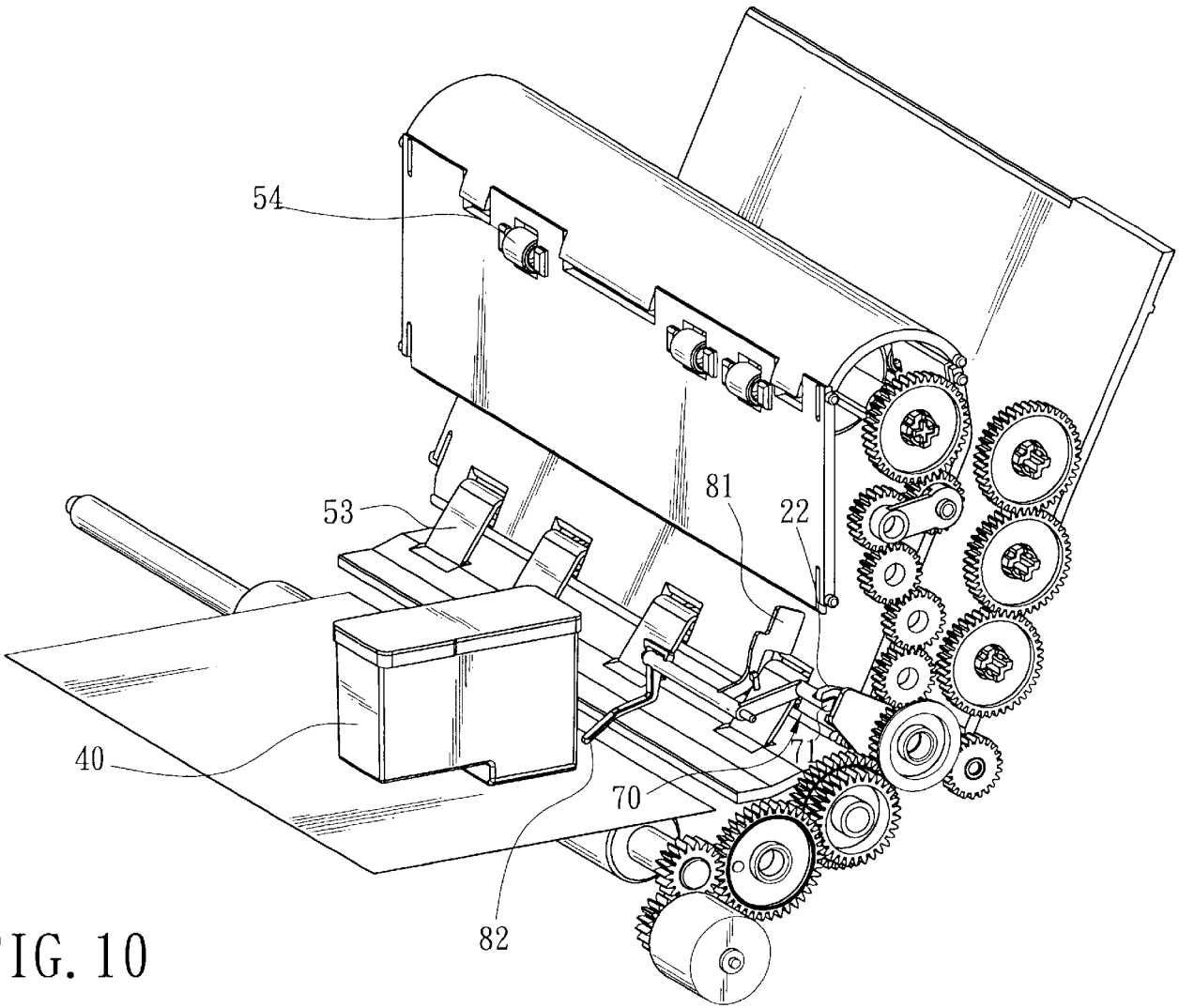
FIG. 10 is a schematic drawing of the first embodiment of the page sensor of the invention.

As shown in FIG. 2, the gear 26 coupled with the drive 30 is initiated to rotate by the reverse rotation of the drive 30. The rotation of the gear 26 causes the first switch 20 to rotate due to friction. The rotation direction of the first switch 20 shown in FIG. 2 is counterclockwise such that the passive gear 21 on the first switch 20 swings upward and couples with the gear 14 set on the bottom of the holding unit 10. Hence the feeding roller 13 rotates and a sheet of paper 11 placed in the holding unit 10 is pulled out then the front of the sheet of paper 11 reaches the rear 82 of the page sensor 80. As shown in FIG. 3, the middle of the page sensor 80 is pinned to the printing device of the invention (see also FIG. 10). Therefore when the sheet of paper 11 goes through the page sensor, the rear 82 of the page sensor 80 is pushed to swing upward such that the page sensor 80 rotates around the pin set in the middle of it. Consequently the obstructing unit 70 and the sensing flag 81 on the top of the page sensor 80 is driven to swing downward. The downward flag 81 makes the sensors (not shown in the figure) set on the both sides of the sensing flag 81 sense that the sheet of paper 11 is in position. Accordingly the drive 30 is about to change rotating direction and the printing unit 40 is ready to start the printing job.

Figure 4:
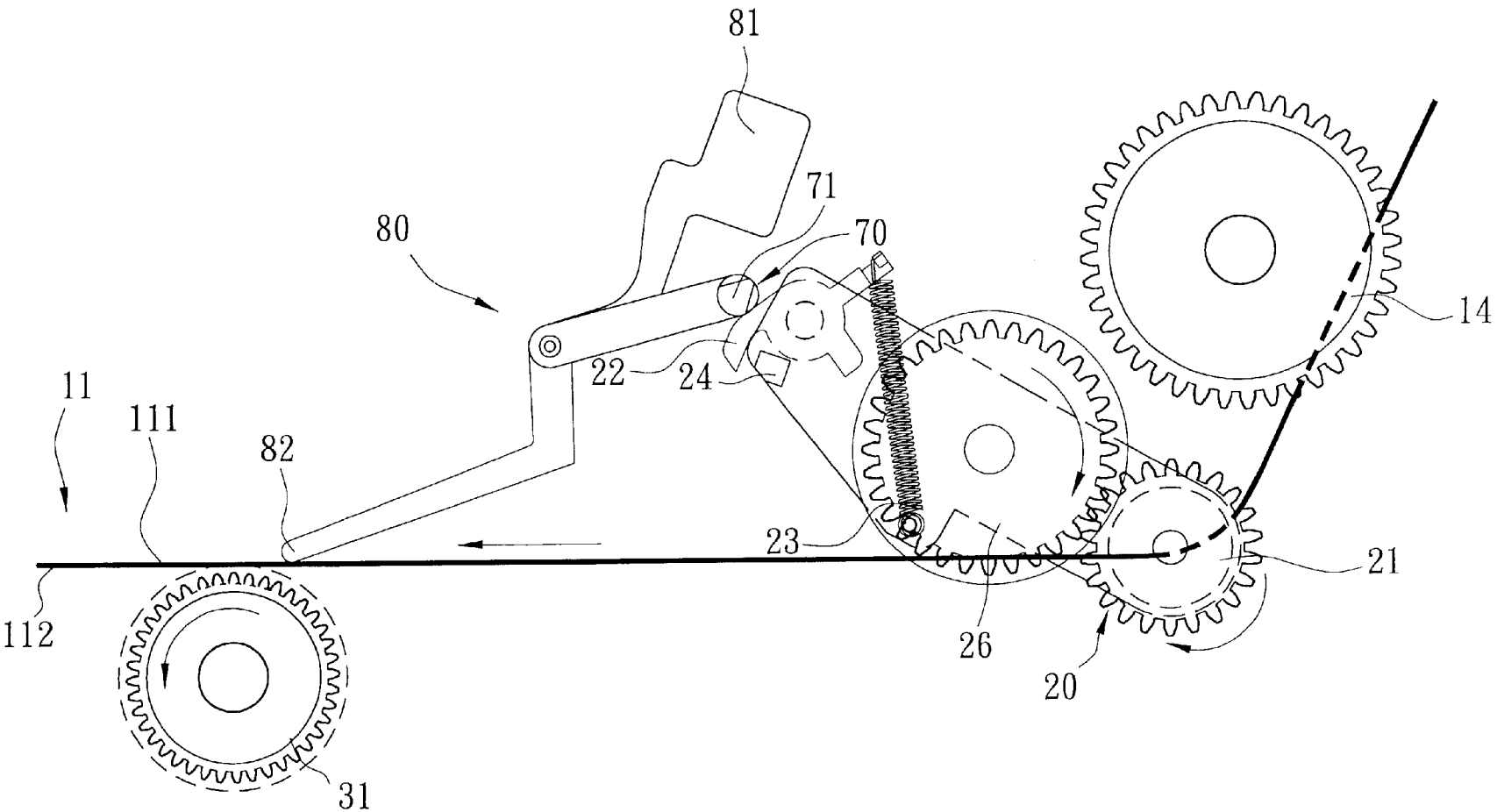
FIG. 4 is a schematic drawing of the first switch in the original position of the invention.
Figure 5:
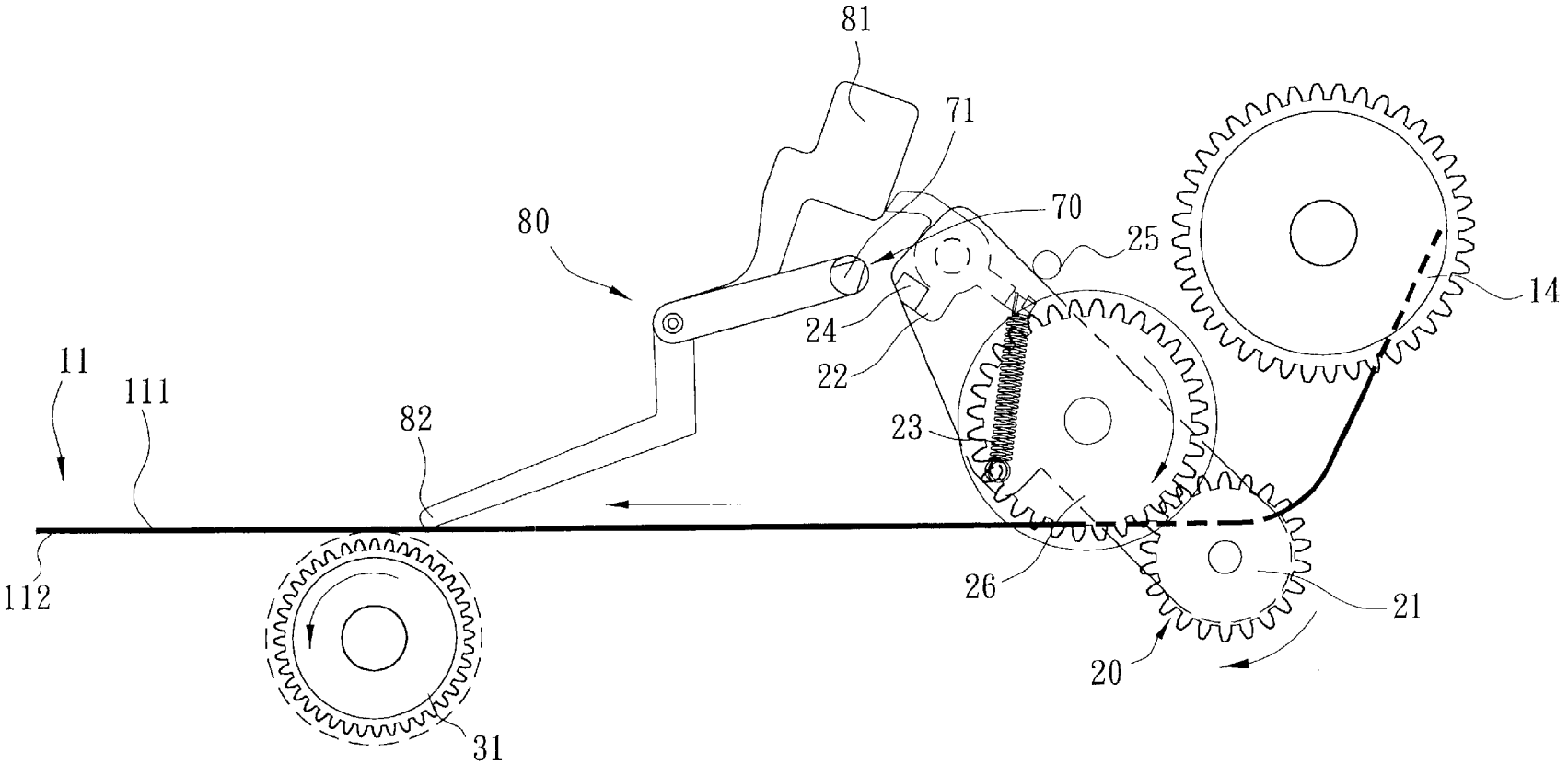
FIG. 5 is a schematic drawing of the printing status of the invention.

Next, as shown in FIG. 4, the drive 30 rotates normally to drive the feeding roller 31 to pull the sheet of paper 11 into the bottom of the printing unit 40 so that the front side 111 of the sheet of paper 11 can be printed on. Meanwhile the first switch 20 is driven to rotate clockwise by the ordinary rotation of the drive 30 to let the passive gear 21 swings downward such that the first switch 20 separates from the holding unit 10 and is finally stopped by the dead point 25. Simultaneously the hook 22 pinned on first switch 20 is brought to close with the obstructing lever 71 of the obstruction unit 70 and then rotates around the obstructing lever to pass through it by the downward swing of the first switch 20. Eventually the hook 22 on first switch 20 is again in its original position through the action of the spring 23 (see FIG. 5).

Figure 6A:
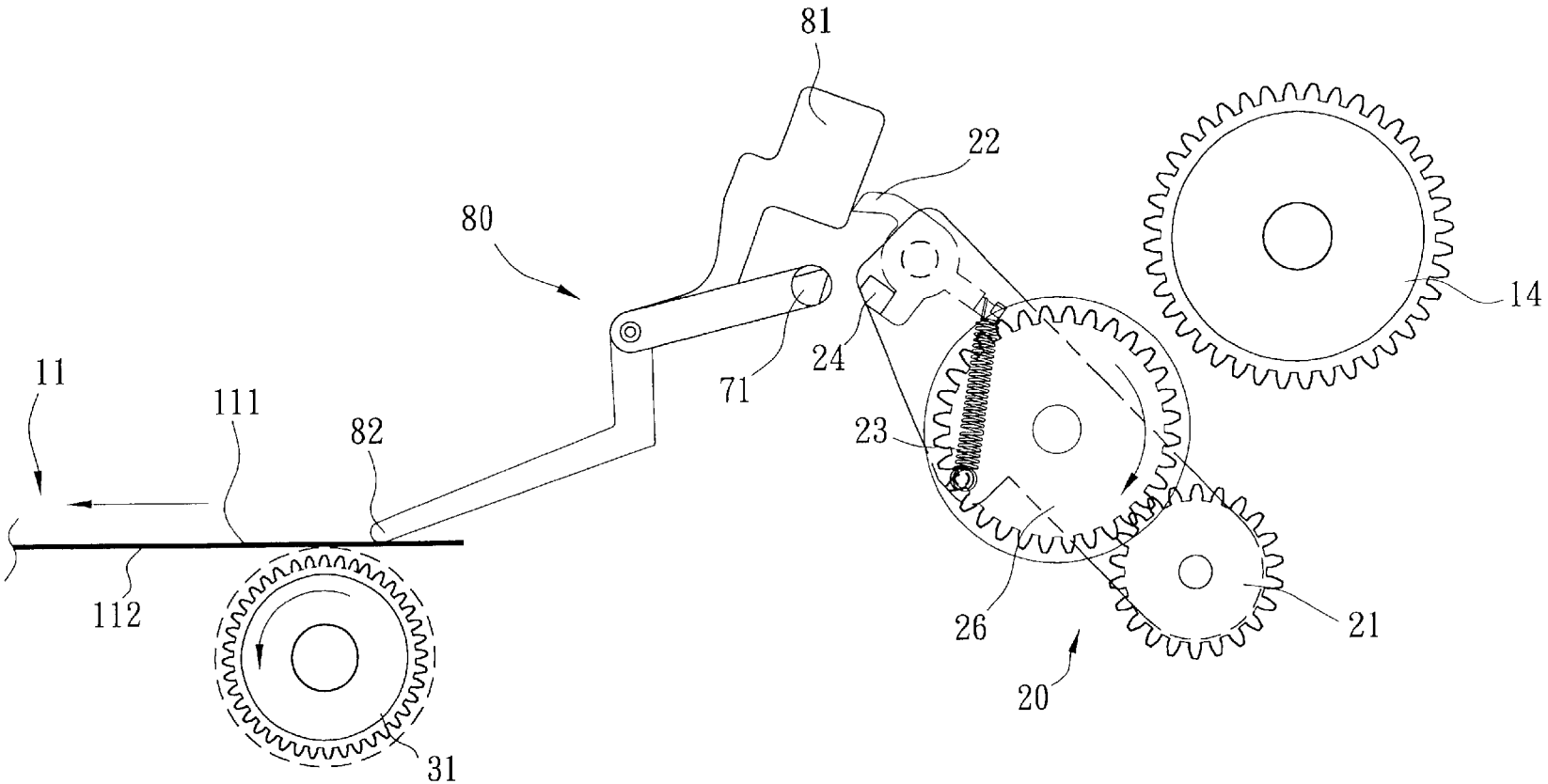
FIGS. 6A–6B are schematic drawings of the invention after completing the printing.
Figure 6B:
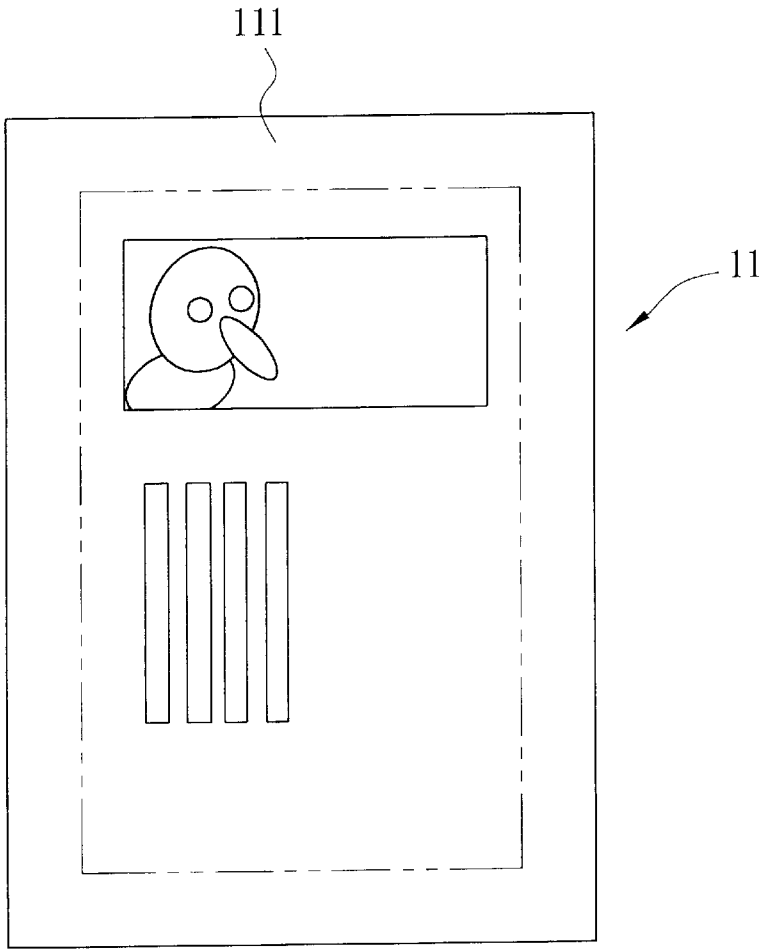
Figure 7:
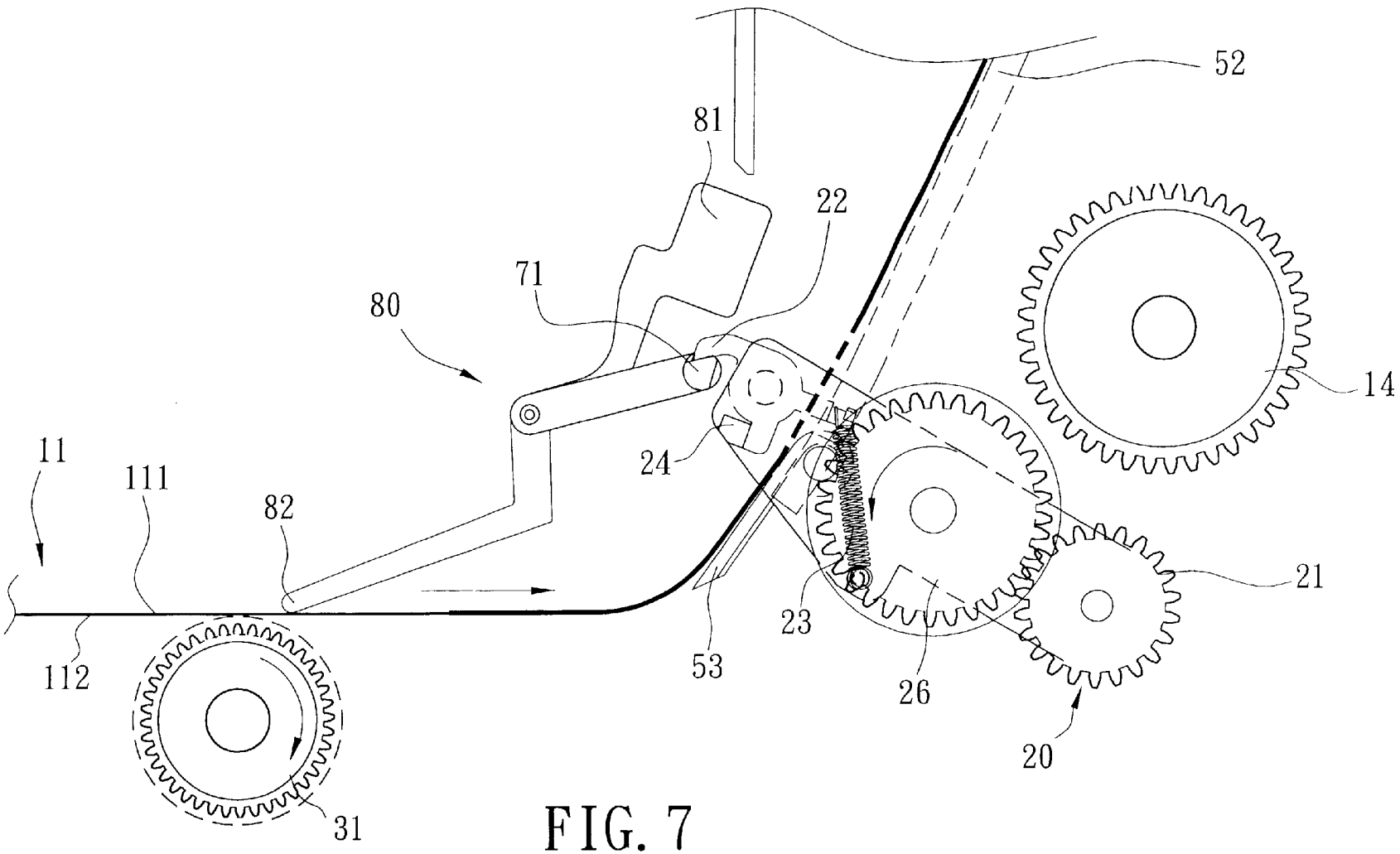
FIG. 7 is a schematic drawing of a sheet of paper entering the turning unit of the invention.

Finally, the feeding roller rotates continuously until the printing for the front side 111 of the sheet of paper 11 has been completed (see FIGS. 6A and 6B). Next it has to wait for some time until the ink dries or the toner adheres on the paper, then the drive 30 rotates once again in reverse to push the feeding roller 31 to fed the sheet of paper 11 into the turning unit 50. The first switch 20 rotates counterclockwise by the reverse rotation of the drive 30, but the obstruction unit 70 is pushed by the sheet of paper 11 to swing downward so that the hook 22 on the first switch 20 is confined by the obstructing lever 71 of the obstructing unit 70 so as not to be able to couple with the holding unit 10, as shown in FIG. 7. The hook 22 is also confined simultaneously by the obstructing block 24 and acts consequently as a one-way hook and is confined in the present position to prevent the holding unit 10 from feeding the papers repeatedly. Guiding elements 53 associated with the turning unit 50 guide the sheet of paper 11 to enter the turning unit 50 but not the holding unit 10 (see FIG. 10).

Figure 8A:
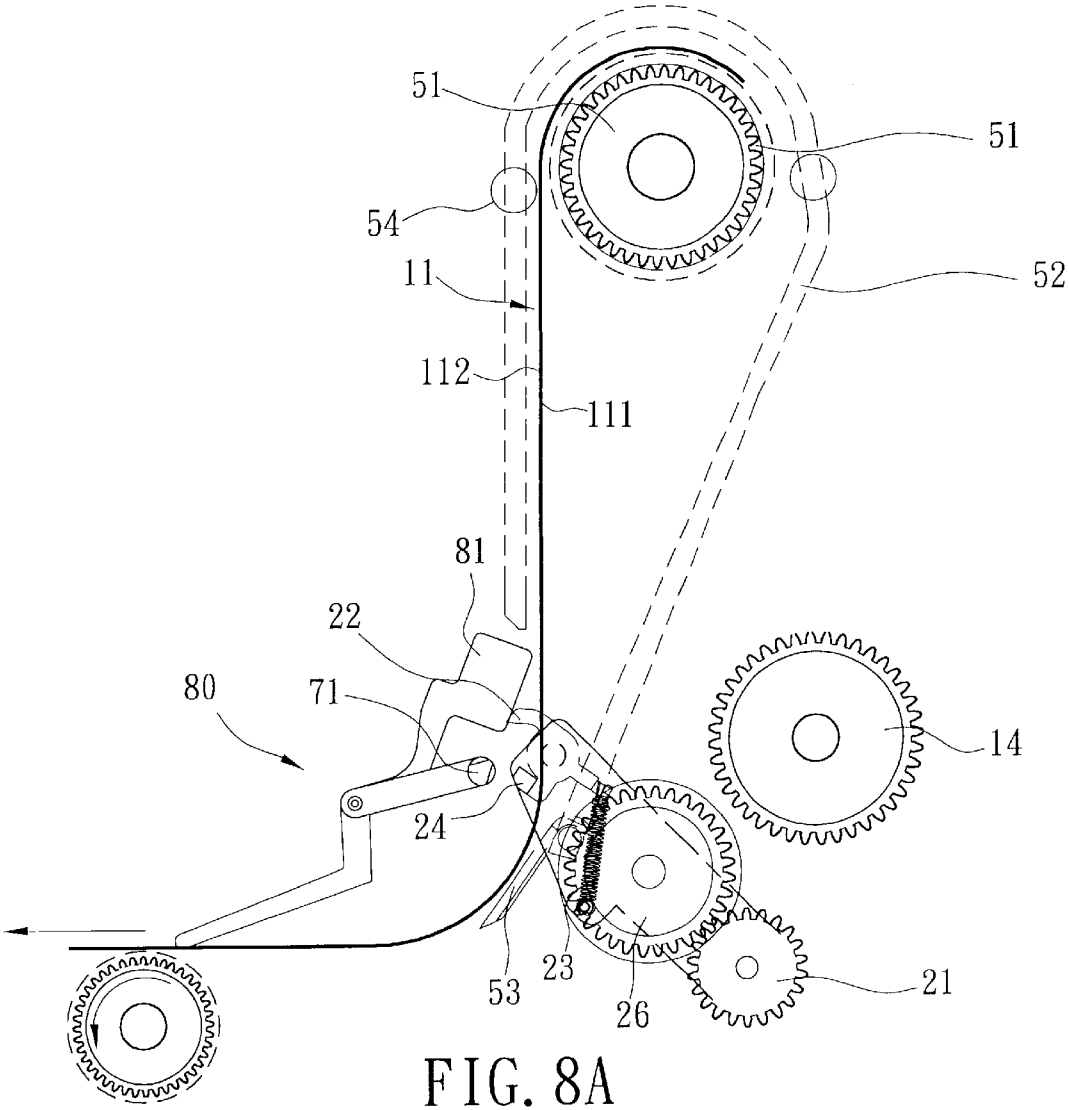
FIGS. 8A–8B are schematic drawings of a sheet of paper entering the printing unit of the invention.
Figure 8B:
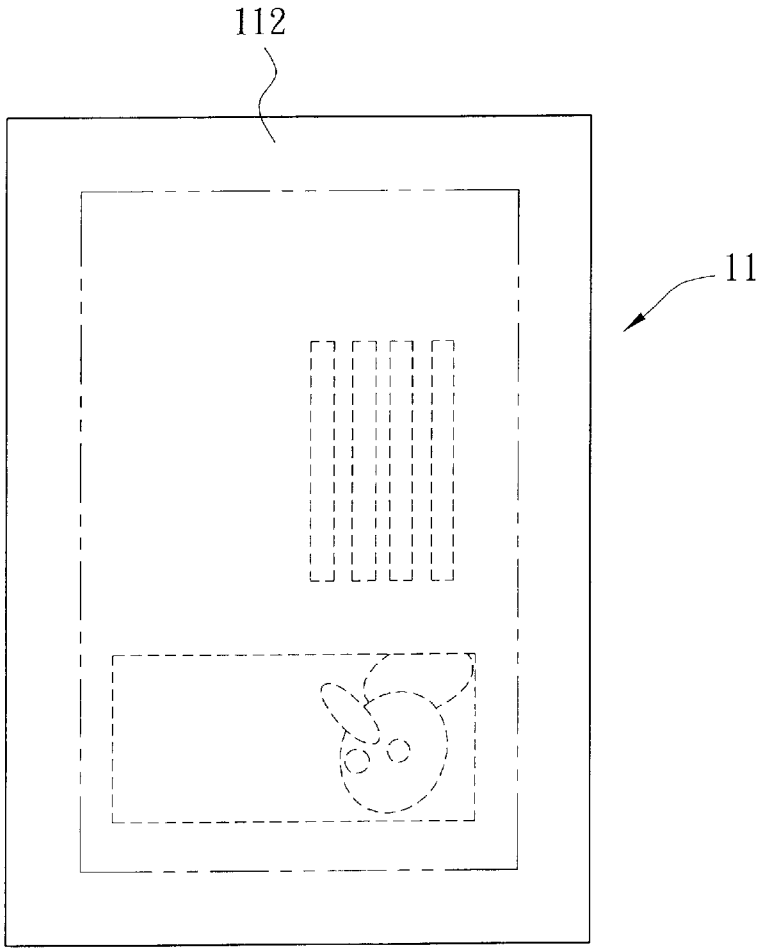
Figure 9:
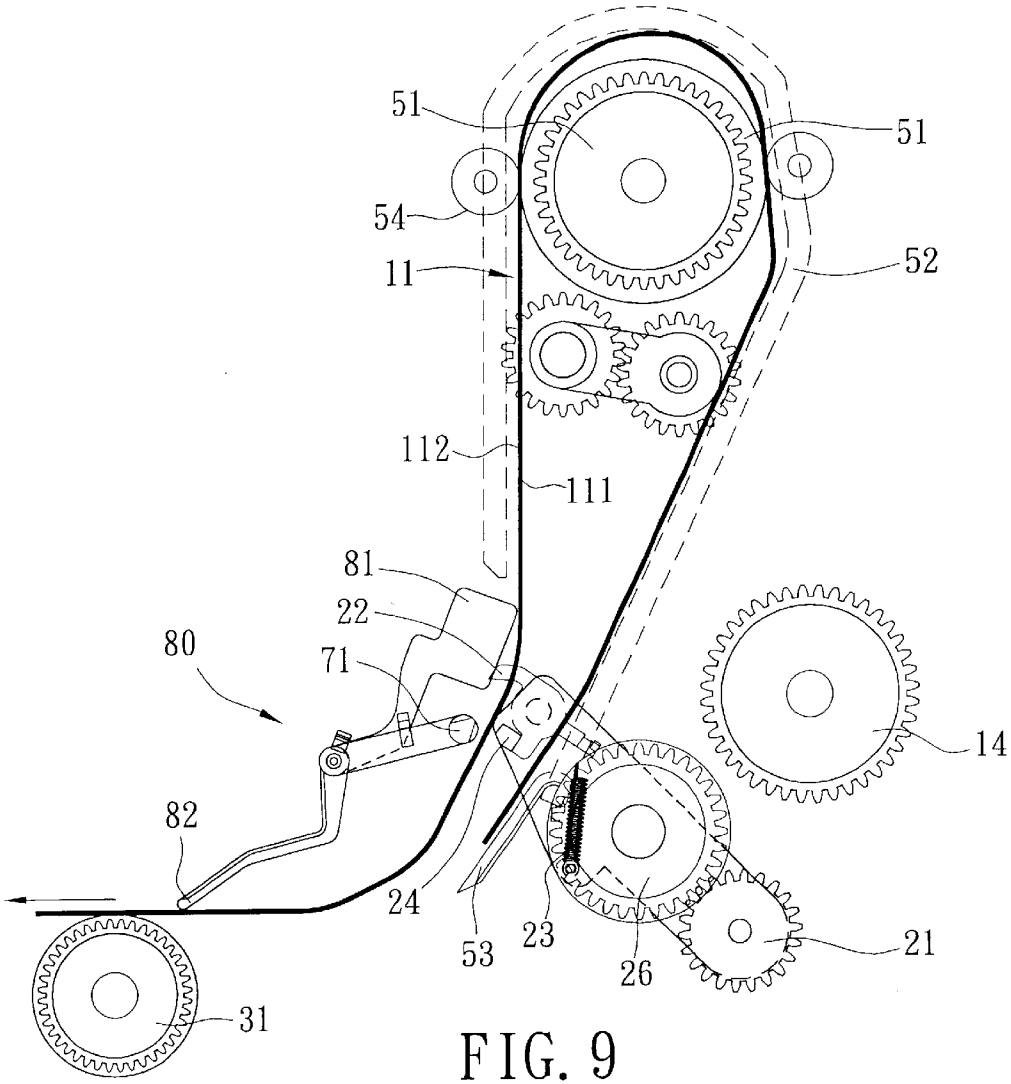
FIG. 9 is a schematic drawing of the invention for a sheet of paper with printed data on its reverse side.

The turning unit 50 has a space in which turning rollers 51 and idler rollers 54 with flexible positions are set. The sheet of paper 11 is pressed by the idler rollers 54 to be in contact with the turning rollers 51 and is driven by them to be turned over by the guidance of the frame 52 of the turning rollers. Similarly the turning rollers 51 do not need to be directly coupled with the first switch 20 and their position dependents upon the length of the sheet of paper 11 and the types of the printers. The sheet of paper 11 being fed by turning rollers 51 continuously and then reenters the feeding roller 31. After the sheet of paper 11 enters the feeding roller 31, the drive 30 rotates once again normally to pull the sheet of paper 11 into the printing unit 40, now the back side 112 of the sheet of paper 11 can be directed to the printing unit 40 so that printed data can be printed on it, as shown in FIGS. 8A and 8B. The turning unit 50 can also be selectively coupled with the turning rollers 51 by the second switch 60. When the drive 30 rotates reversely, the second switch 60 can rotate counterclockwise due to friction so that the passive gear 61 is brought to swing upward and couple with the turning rollers 51. The passive gear 61 can also be brought to swing downward to separate from the turning rollers 51 and prevent the turning rollers 51 from pulling the sheet of paper 11 back when the drive 30 rotates normally, as shown in FIG. 9.

Figure 11:
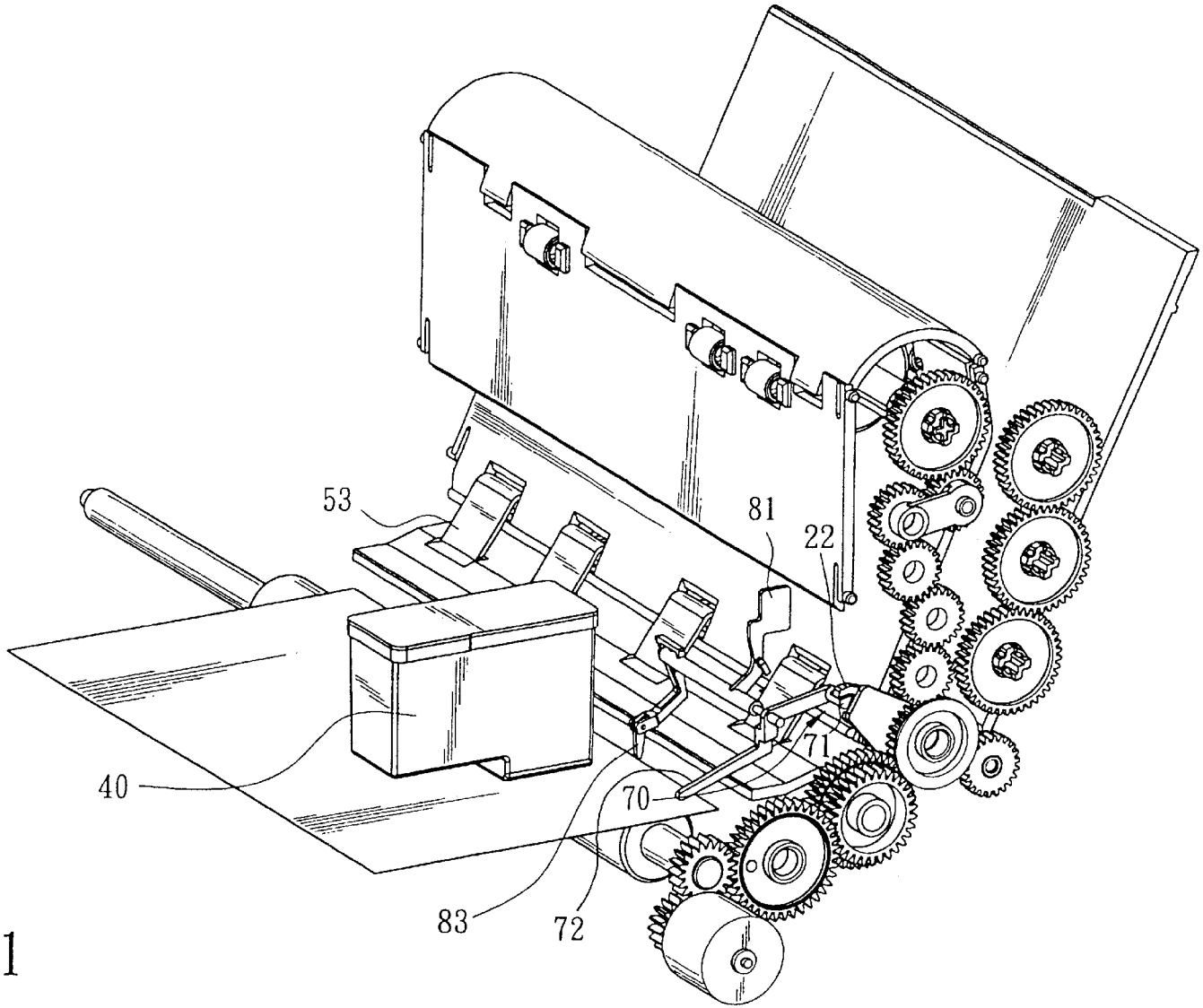
FIG. 11 is a schematic drawing of the second embodiment of the page sensor of the invention.
Figure 12:
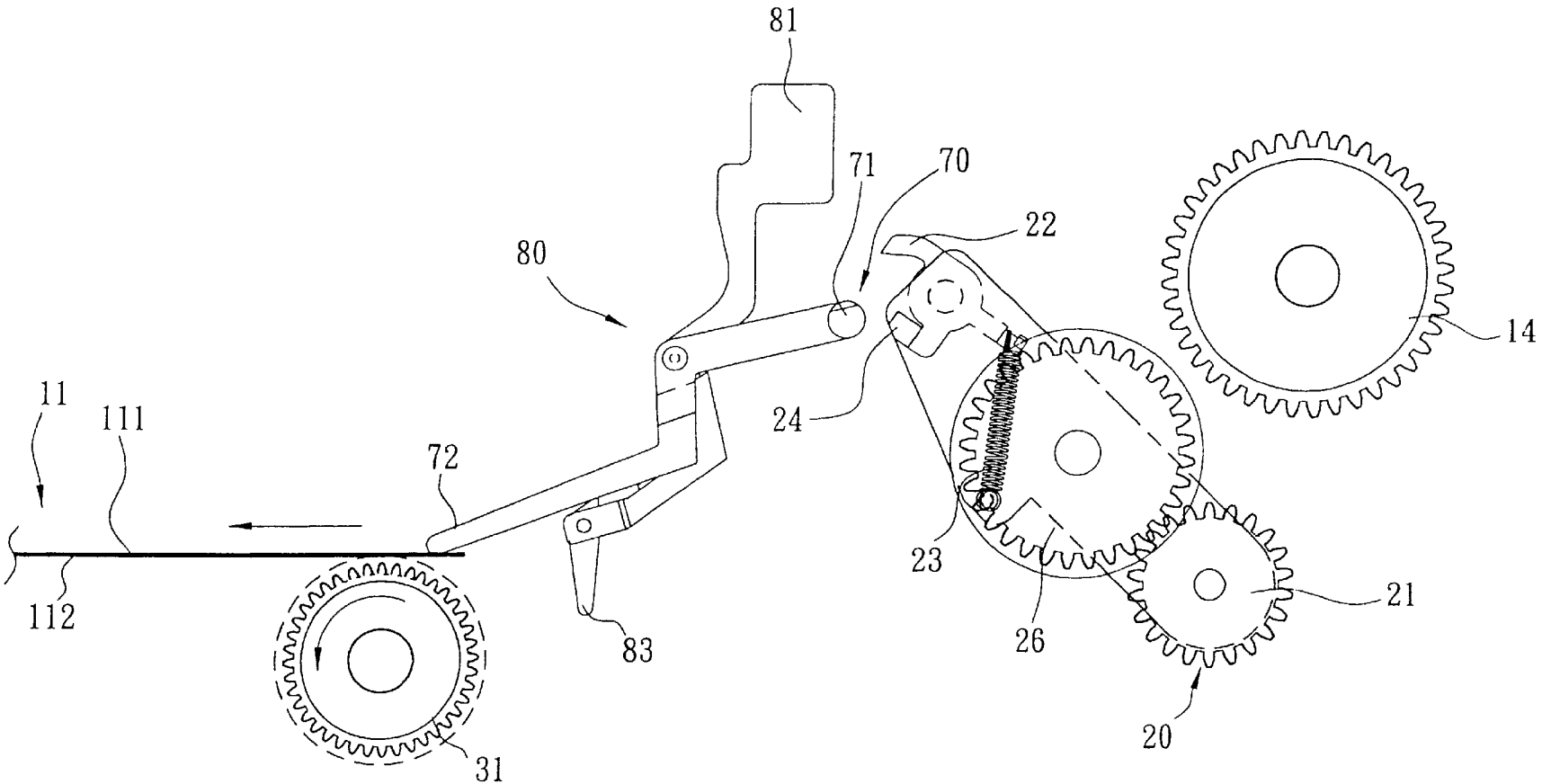
FIGS. 12 and 13 are schematic actuating drawings of the second embodiment of the paper sensor of the invention.
Figure 13:
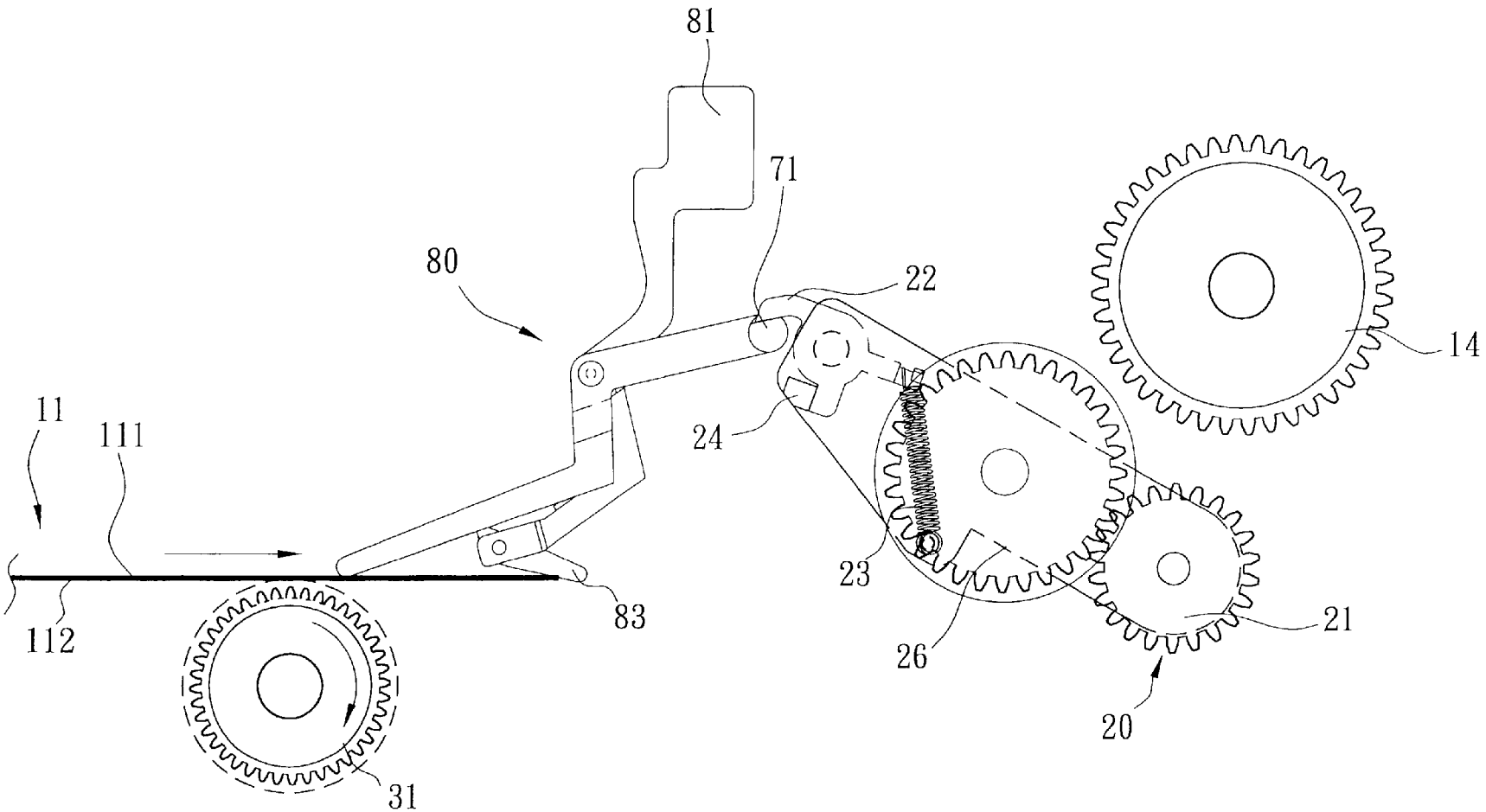

However, the design described above has two disadvantages, the first is, it is not possible to apply the page sensor 80 to detect whether the rear edge of sheet of paper 11 is close to the feeding roller 31 while printing unit 40 is printing on the front side 111. The second is, while the back side 112 of the sheet of paper 11 is facing to the printing unit 40 and about to enter the feeding roller 31, the page sensor 80 can't detect whether the sheet of paper 11 is in position because the obstructing lever 71 is caught by the hook 22. Therefore, as shown in FIG. 11, the second embodiment of the invention is to separate the page sensor 80 from the obstructing unit 70 and let the rear 72 of the obstructing unit 70 be larger than the rear 82 of the page sensor 80. In this way the rear 82 of the page sensor 80 can separate from the rear 72 of the obstructing unit 70 to make the sensing part 81 of the page sensor 80 swing upward to sense that the rear edge of sheet of paper 11 is close to the feeding roller 31. But the rear 72 of the obstructing unit 70 is still pushed by the sheet of paper 11, as shown in FIG. 12, so that the obstructing unit 70 can be applied to prevent the first switch 20 from coupling with the holding unit 10. In order to make sure that the sheet of paper 11 can enter the turning unit 50 freely, a movable part 83 which can be applied to allow the sheet of paper 11 to pass through it is also designed and associated with the page sensor 80 (shown in FIG. 13). Similarly, by the separated page sensor 80 and the obstructing unit 70, the page sensor 80 is in neutral position and free to detect whether the sheet of paper 11 is in position while the back side 112 of the sheet of paper 11 is facing to the printing unit 40 and about to enter the feeding roller 31.

The invention relates to a double-sided printing device in which the switches are driven by a drive to swing and couple with the holding and turning units selectively such that the path for paper-picking of the sheet of paper can be controlled and the sheet of paper can be guided and turned over inside the turning unit to reenter the printing unit. The double-sided printing device is designed as a built-in turning mechanism and is driven only by a single drive so that its production cost can be greatly reduced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A double-sided printing device for paper handling applied to print data on a sheet having a first and a second side for printing, said printing device comprising:

a holding unit applied to store and supply said sheet;

a first switch selectively coupling with said holding unit;

a drive connected with said first switch for supplying power to said first switch;

a printing unit settled on one side of said first switch, said first switch is driven by said drive to provide power to said holding unit to feed said sheet into said printing unit to allow said first side of said sheet to be printed;

a turning unit coupled with said first switch possessing an space for the circumrotation of said sheet; and an obstructing unit settled beside said first switch and confining selectively said first switch to couple with said holding unit;

wherein said first switch is confined not to couple with said holding unit by said obstructing unit after said printing unit has finished the printing on said first side of said sheet, said sheet is guided by said turning unit into said space for circumrotation to be turned over and then reenters said printing unit for the printing on said second side of said sheet of paper.

2. The double-sided printing device for paper handling in accordance with claim 1, wherein said holding unit further comprises a reservoir for placing a plurality of sheets.

3. The double-sided printing device for paper handling in accordance with claim 2, wherein said drive rotates reversely to push said first switch to couple with said holding unit so that said holding unit feeds said sheet placed in said reservoir of said holding unit to said printing unit while by the ordinary rotation of said drive, said first switch is pushed to escape from said holding unit to feed said sheet to said printing unit to print data on said first side of said sheet of paper and simultaneously to prevent said holding unit to feed papers repeatedly.

4. The double-sided printing device for paper handling in accordance with claim 3, wherein said drive rotates once again reversely to drive a medium to push said obstructing unit to confine the first switch not to couple with said holding unit to prevent said holding unit to feed sheets, and said turning unit is pushed by said first switch to turn over said sheet which front side has been printed previously and to feed said sheet of paper again to said printing unit.

5. The double-sided printing device for paper handling in accordance with claim 4, wherein said turning unit utilizes a turning roller settled inside said space for circumrotation to turn over said sheet of paper which front side has been printed previously.

6. The double-sided printing device for paper handling in accordance with claim 5, wherein said turning unit is coupled with said first switch by a second switch and by another reverse rotation of said drive, said second switch is pushed to couple with said turning roller by said first switch such that said turning roller turns over said sheet which first side has been printed previously and then by the ordinary rotation of said drive, said second switch is pushed to escape from said turning roller by said first switching to feed said sheet to said printing unit.

7. The double-sided printing device for paper handling in accordance with claim 1, wherein said drive is coupled with said first switch by a feeding roller and by said feeding roller said sheet is fed to said printing unit.

8. The double-sided printing device for paper handling in accordance with claim 7, further comprises a page sensor settled beside said feeding roller, and said page sensor is actuated when said sheet goes through and enters or leaves said printing unit.

9. The double-sided printing device for paper handling in accordance with claim 8, wherein a rear of said page sensor stretches across the path for paper-handling of said sheet and the middle of said page sensor is pined to said printing device such that when said sheet of paper goes through said page sensor, said rear of said page sensor is pushed upward to make the top of said page sensor swing downward to sense that said sheet of paper has passed.

10. The double-sided printing device for paper handling in accordance with claim 9, wherein said obstructing unit is connected with one side of said page sensor and when said sheet goes through and pushes said page sensor, said obstructing unit simultaneously is driven to swing downward to produce obstruction for papers.

11. The double-sided printing device for paper handling in accordance with claim 10, wherein said first switch possesses a one-way hook corresponding with said obstructing unit and when said obstructing unit in position of obstruction, said one-way hook only confines the motions of said first switch in one-way.

12. The double-sided printing device for paper handling in accordance with claim 9, wherein said page sensor stretches similarly above said path for paper-advance of said sheet as a rear of said obstructing unit and the stretching length of said obstructing unit is larger than the one of said page sensor such that said obstructing unit still produces obstruction for papers after a front side of said sheet has been printed and said sheet of paper has escaped from said rear of said page sensor.

13. The double-sided printing device for paper handling in accordance with claim 12, wherein said rear of said page sensor is pined with said page sensor so that said sheet which first side has been printed still goes through said page sensor and enter said turning unit.

14. The double-sided printing device for paper handling in accordance with claim 12, wherein said first switch having a one-way hook corresponding with said obstructing unit, when said obstructing unit produces obstruction for papers, said one-way hook confines the motions of said first switch in one-way.

15. The double-sided printing device for paper handling in accordance with claim 1, wherein said turning unit further comprises a guiding element applied to prevent said sheet which the first side has been printed to enter said holding unit.

* * * * *